United States Patent [19]

Horikawa

[11] 3,940,723

[45] Feb. 24, 1976

[54] INSTANTANEOUSLY TRIPPING DEVICE FOR CIRCUIT INTERRUPTER

[75] Inventor: Masao Horikawa, Yamato-kooriyama, Japan

[73] Assignee: Terasaki Denki Sangyo Kabushiki Kaisha, Osaka, Japan

[22] Filed: May 20, 1974

[21] Appl. No.: 471,774

[30] Foreign Application Priority Data

May 21, 1973 Japan ..... 48-55593

[52] U.S. Cl. ..... 335/174; 335/195; 335/204

[51] Int. Cl.[2] ..... H01H 9/00

[58] Field of Search ..... 335/204, 16, 195, 170, 335/174, 24

[56] References Cited

UNITED STATES PATENTS

| | | | |
|---|---|---|---|
| 2,659,783 | 11/1953 | Casey | 335/204 X |
| 2,809,251 | 10/1957 | Findley | 335/204 X |
| 3,072,765 | 1/1963 | Hauser et al. | 335/16 |

*Primary Examiner*—G. Harris

*Attorney, Agent, or Firm*—Wenderoth, Lind & Ponack

[57] ABSTRACT

The disclosed instantaneously tripping device includes a stationary iron core encircling a conductor and responsive to a flow of shortcircuiting current through the conductor to attract a movable iron core to open contacts. A locking and releasing plate are operatively coupled to the movable core to transfer the movement of a closing latch to the latter. After the completion of the closing operation effected by a switching mechanism, the locking plate locks the movable core while only during the closing operation of the switching mechanism does the releasing plate release the movable core to permit it to be attracted by the stationary core.

1 Claim, 8 Drawing Figures

INSTANTANEOUSLY TRIPPING DEVICE FOR CIRCUIT INTERRUPTER

BACKGROUND OF THE INVENTION

This invention relates to an instantaneously tripping device operative upon closing a circuit interrupter.

Recent series overcurrent tripping devices for circuit interrupters are provided with long timing, short timing and instantaneous trip elements that are generally called three elements. These trip elements are selectively operative in response to the magnitude of a current flowing through the associated circuit interrupter. In general, the higher the current the shorter the time delay after which the circuit interrupters are arranged to be opened. For example, the trip element having the short timing characteristic is responsive to a flow of high current approximating a shortcircuiting current to open the associated circuit interrupter with a time delay corresponding to from several to several tens of cycles of the current. Such trip elements are used for selective interruptions. In brief, where a circuit interrupter has a load side divided into a multiplicity of branches each having connected thereto one circuit interrupter having a small capacity, the occurrence of a shortcircuiting fault at any one of terminal points results, of course, in the opening of a subordinate circuit interrupter disposed at that terminal point where the fault has occurred. Under these circumstances, if a master circuit interrupter operatively associated with that subordinate one would have been opened in response to the shortcircuiting fault then a multiplicity of trouble free branches connected to the same would be opened resulting in inconvenience. Therefore, if the master circuit interrupter is maintained in its closed position until the subordinate circuit interrupter has been opened or until after a time interval of from several to several tens of cycles of the current than the supply of electric power can continued without hindrance. This is because all the branches except for the branch having the fault occurring thereon are trouble free at a time point when the subordinate circuit interrupter has been opened.

Also, according to the type of circuit interrupters, the instantaneous trip element may be omitted from tripping devices by having the short timing region including even the interrupting current which should be properly imposed upon the associated circuit interrupter. This results in the necessity of imparting to circuit interrupters proper electrical and mechanical strengths sufficient to permit high currents such as a shortcircuiting current to flow therethrough during several tens of the cycles of current. In addition, the tripping devices not including the instantaneous trip element are required to perform the operation of completely closing the shortcircuited branch within the same time interval. Upon closing a shortcircuited branch, a very high electromagnetic repulsion is generated across the contacts involved. This leads to the necessity of increasing the electrical energy required to close the shortcircuited circuit against the high repulsion, beyond the required for the normal closing operation and also to the need of providing corresponding equipment. For example, a closing electromagnetic solenoid circuit be made larger. If such closing energy is insufficient then an electric arc will occur across the contacts at an intercontact distance at which the closing force is balanced with the electromagnetic repulsion and during several tens of cycles of the current resulting in great damage to the contact units.

SUMMARY OF THE INVENTION

An object of the present invention is to provide a new and improved instantaneously tripping device operative upon closing a circuit interrupter having imposed thereon the requirements as above described and which device is instantaneously operative only in the closing process performed by a switching mechanism involved, while the tripping device is put in its locked position where it is prevented from being operated after the completion of the closing operation.

The present invention accomplishes this object by the provision of an instantaneously tripping device operative upon closing a circuit interrupter and comprising instantaneously tripping electromagnet means disposed so as to encircle a conductor, the electromagnet means including a movable iron core actuatable by a closing latch included in a switching mechanism for a circuit interrupter, through both a locking plate and a releasing plate, and a stationary iron core operatively associated with the movable iron core so that, after the completion of the closing operation performed by the switching mechanism, and during the closure of the circuit interrupter the locking plate locks the movable iron core in its locked position to prevent the movable iron core from being attracted by the stationary iron core, wherein the locking plate is released only in the closing process effected by the switching mechanism to permit the movable iron core to be attracted by the stationary iron core, and wherein, upon a flow of high current through the conductor due to the closure of contacts in the closing process effected by the switching mechanism, the movable iron core is operated to actuate the tripping device to open the contacts.

BRIEF DESCRIPTION OF THE DRAWINGS

The present invention will become more apparent from the following detailed description taken in conjunction with the accompanying drawings in which.

Throughout the Figures like reference numerals designate identical components.

DESCRIPTION OF THE PREFERRED EMBODIMENT

Figure 1:
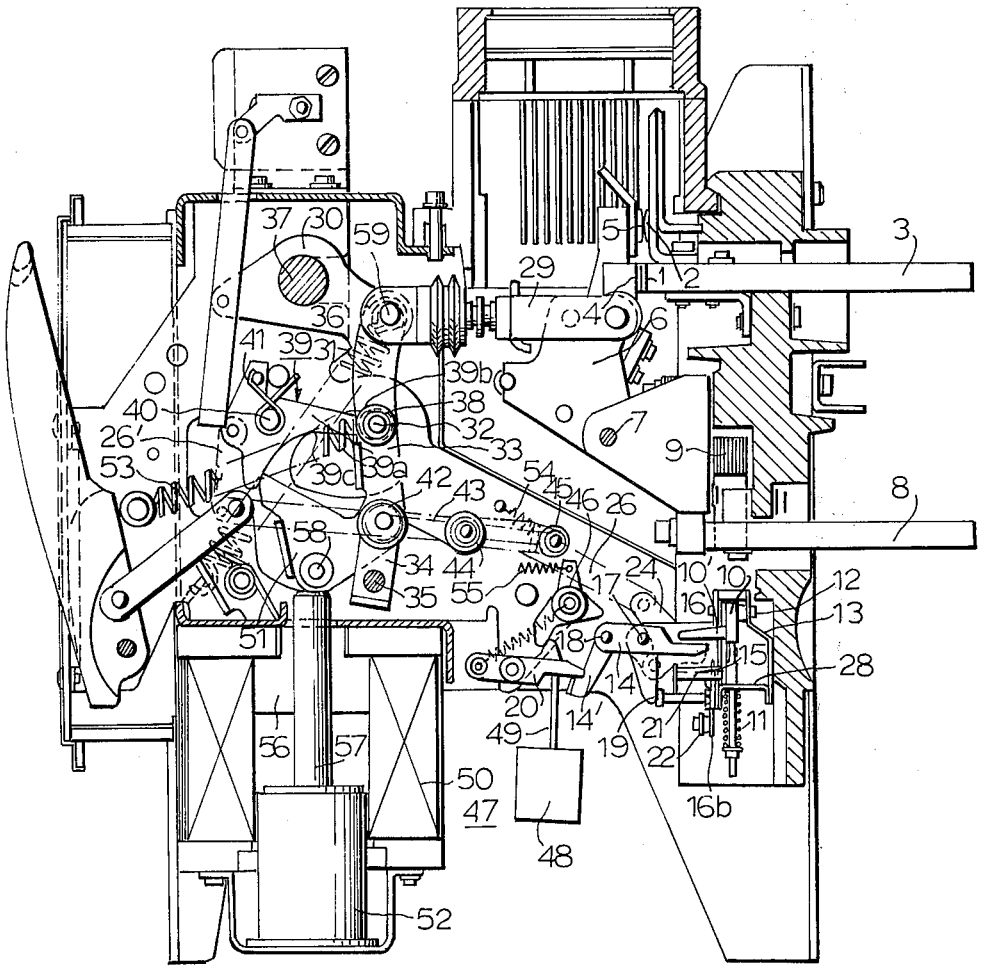
FIG. 1 is a fragmental side elevational sectional view of a circuit interrupter embodying the principles of the present invention and illustrated in its closed position with the section taken along the central axis thereof.

Referring now to the drawings, a circuit interrupter shown in FIG. 1 comprises a contact assembly including a main stationary contact 1 and an arcing stationary contact 2 fixedly secured to a terminal 3 on the source side, a main movable contact 4 and an arcing movable contact 5 fixedly secured to a movable contact holder 6 to be separately engaged by the stationary contacts 1 and 2 respectively, and a contact spring (not shown) serving to provide a contact pressure under which each of the movable contacts 3 or 4 is maintained engaged by the mating stationary contact 1 or 2. The movable contact holder 6 is pivotably supported on a pivot pin 7 and can be brought into its closed or open position by means of a switching mechanism as will be described hereinafter.

Figure 5:
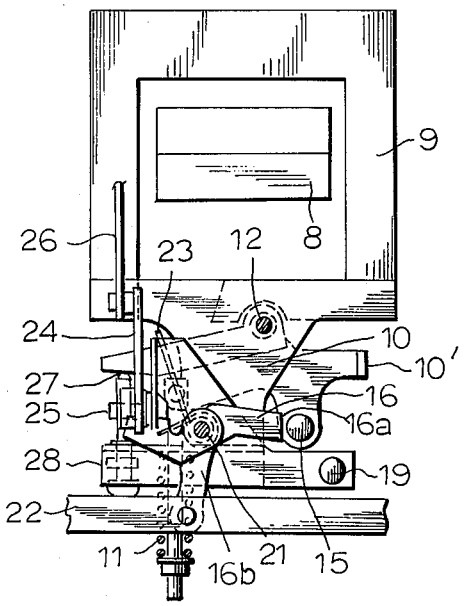
FIG. 5 is a fragmental front elevational view of the instantaneously tripping device shown in FIG. 1 and constructed in accordance with the principles of the present invention after the switching mechanism shown in FIG. 1 has performed the closing operation.

A terminal 8 on the load side forms a current conductor and is encircled with a stationary iron core 9 of hollow square cross section having one side open (see FIG. 5). The stationary iron core 9 forms a part of an electromagnet for an instantaneously tripping device and a movable iron core 10 is disposed adjacent the open side of the stationary iron core 9. The movable iron core 10 has one end adapted to be attracted by the stationary iron core 9 against the action of a set compression spring 11 upon a flow of high current through the conductor 8. The spring tends to normally bias the movable iron core 10 away from the stationary iron core 9. A pin 12 attaches the stationary iron core 9 to a frame 13 while pivotally supporting the movable iron core 10 on the frame 13. The movable iron core 10 includes a portion folded in the form of a protrusion having one end 10′ facing an instantaneously tripping lever 14.

A pin 15 is disposed on a lower protrusion as viewed in FIG. 5 from the movable iron core 10 to be able to abut against a locking plate 16 at one end 16*a* (see FIG. 5). The lever 14 is pivotably supported on the frame 13 at a pivot 17 and is integrally connected to another instantaneously tripping lever 14′. The lever 14 has an end capable of abutting against the end 10′ of the folded protrusion of the movable iron core 10 as above described while the lever 14′ has one end normally touching a bolt-shaped stopper 19 therefor and the other end capable of turning a trip member 20.

The locking plate 16 has an inverted U shape and is pivotably supported on a pin 21 planted on the frame 13. The U shaped plate 16 has one lateral side divided into two legs one of which has an end 16*a* capable of abutting against the pin 15 as above described and the other of which has an end 16*b* connected to a connecting link 22 (see FIG. 5). A locking spring 23 includes an intermediate portion disposed around the pin 21 on the locking plate 16 and tends to rotate the locking plate 16 in the clockwise direction as viewed in FIGS. 5 through 7. The connecting link 22 is similarly connected to similar locking plates (not shown) disposed for other poles.

A releasing plate 24 is pivotably supported on the frame 13 on a pivot 25 and has a lower end capable of turning the upper end of the locking plate 16. The upper end of the releasing plate 24 is connected to a releasing link 26. Bolt-shaped stop 27 limits the movement of the movable iron core 10 and a bracket 28 serves as a support for the frame 13.

Figure 2:
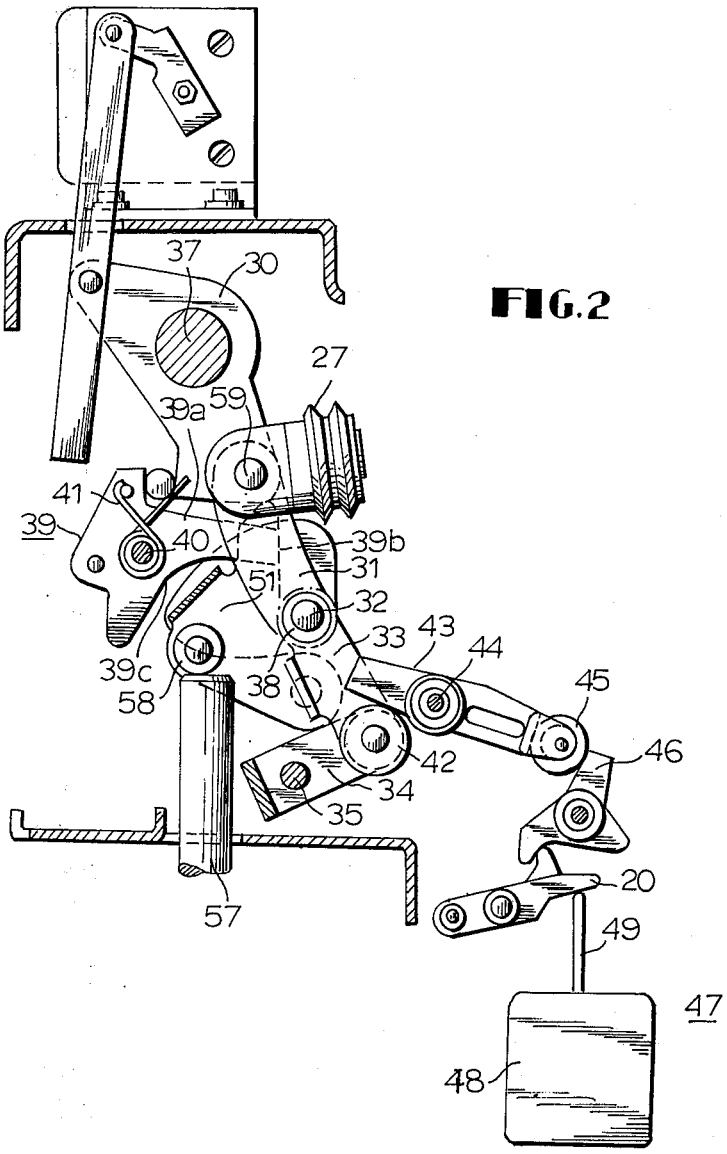
FIG. 2 is a side elevational sectional view of one portion of the arrangement shown in FIG. 1 and in its tripped position.
Figure 3:
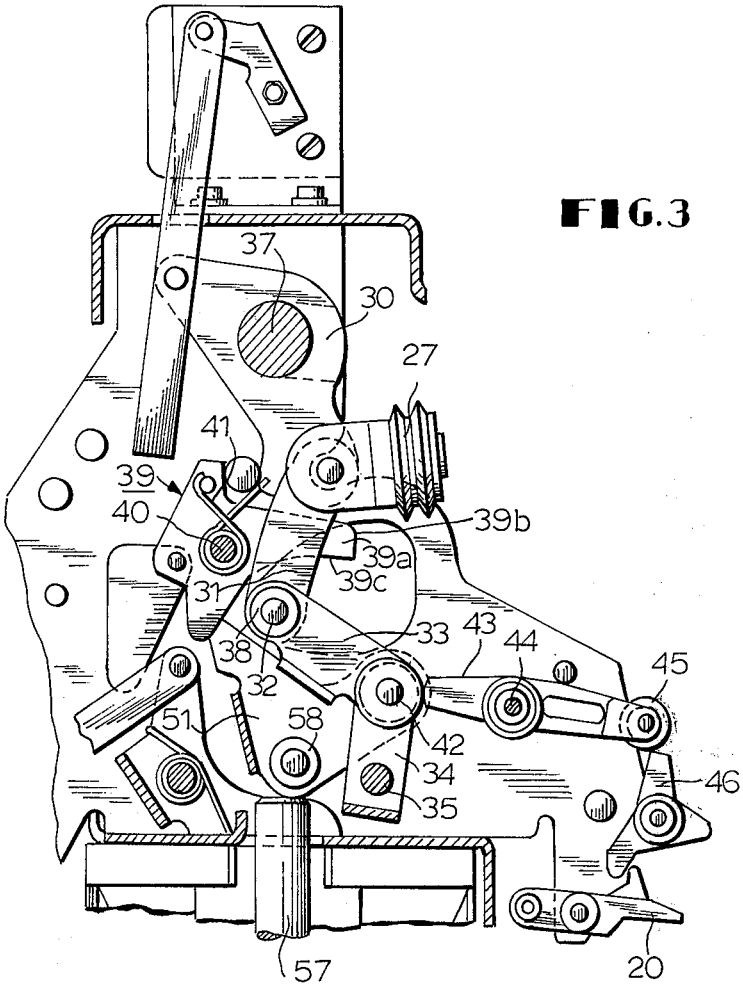
FIG. 3 is a view similar to FIG. 2 but illustrating the portion of the arrangement shown in FIG. 2 in its open position.
Figure 4:
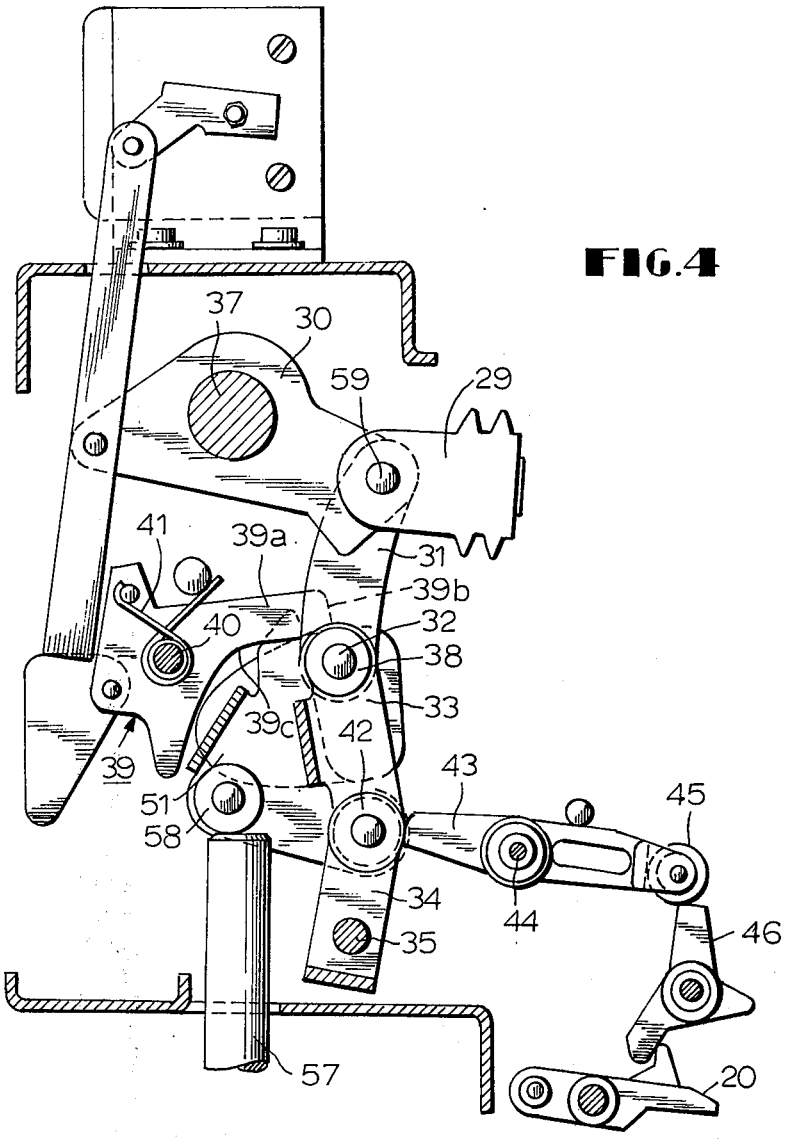
FIG. 4 is a view similar to FIG. 2 but illustrating the portion of the arrangement shown in FIG. 2 in its intermediate position in the closing process.

As shown in FIG. 1, a switching mechanism for opening and closing the contact assembly includes an operating rod 29 of any suitable electrically insulating material having one end articulated to the contact holder 6 for each pole. As best shown in FIGS. 2, 3 and 4, the operating rod 29 has the other end articulated to both a connector lever 30 and an upper toggle link 31 at one end through a pin 59. The upper toggle link 31 has the other end articulated to one end of a lower toggle lever 33 through a shaft 32. The lower toggle lever 33 has the other end articulated to a guide lever 34 pivotably mounted on a pin 35. In the closed position as shown in FIG. 1 an interrupting spring 36 anchored at one end to the pin 59 cooperates with a contact spring (not shown) to tend to always bias the main movable contact 4 to be separated from the main stationary contact 1 while rotating the connector lever 30 in the clockwise direction as viewed in FIG. 1. An interlocking shaft 37 fixedly extends through the central portion of the connector lever 30 as well as those provided for all the remaining poles. A rotational force provided by the connector lever 30 is exerted on a pair of upper and lower toggle levers 31 and 33 respectively to fold them into an obtuse angle. But a closing roller 38 rotatably mounted on the shaft 32 can engage a closing latch 39 pivotably secured to a pivot pin 40 to maintain both toggle links 31 and 33 in the closed position while they are extended as shown in FIG. 1. The closing latch 39 tends to be rotated in the clockwise direction as viewed in FIG. 1 by means of a closing spring 41 disposed around the pin 40. As best shown in FIGS. 2 through 4, the latch 39 has disposed on one side thereof an arm 39*a* provided at the extremity with an engaging surface 39*b* capable of engaging the roller 38. The arm 39*a* has a lower edge formed with a sliding surface 39*c* relatively slidable along the surface of the roller 38.

A rotational force in the clockwise direction as viewed in FIG. 1 or FIGS. 2 through 4 provided by the contactor lever 30 is, for the most part, absorbed by the pin 35 for the guide lever 34 while one portion thereof remains as a force tending to rotate the lever 34 in the clockwise direction as viewed in FIG. 1. When a tripping roller 42 is in abutting engagement with a trip lever 43 pivotably mounted on a pin 44 with a small slip angle, as shown in FIG. 2, that remaining force generates a clockwise torque about the axis of the pin 44. However the trip lever 43 is maintained in equilibrium by having a tripping roller 45 rotatably disposed at that end thereof remote from the roller 42 to abut against one arm of a three arm type tripping latch 46.

A trip device generally designated by reference numeral 47 includes, in addition to the trip member 20 and the components 43 through 46, a trip coil 48, and a movable push rod 49 projecting from the trip coil 48 toward the trip member 20 subsequently abutting against another arm of the trip latch 46.

If an overcurrent flows through a circuit operatively connected to the circuit interrupter in its closed position as shown in FIG. 1 or if a trip coil 48 is energized by any means then the push rod 49 abuts against trip member 20 to rotate the later in the counterclockwise direction as viewed in FIG. 2, and also rotate the tripping latch 46 in the clockwise direction as viewed in FIG. 2 with another arm of the tripping latch 46 engaged by the trip member 20. This causes the tripping latch 46 to disengage from tripping roller 45 to permit the trip lever 34 to be rotated in the clockwise direction thereby to disengage the trip lever 43 from the tripping roller 42. Therefore the guide lever 34 is rapidly rotated in the clockwise direction to rotate the connector lever 30 in the same direction as the trip lever 43 through the interconnected toggle links 31 and 33 until the contact assembly is in its open position.

At that time, a closing coil 50 of an electromagnetic closing device is maintained energized and even if a closing lever 51 has been rotated in the clockwise direction, the closing roller 38 slides along the upper edge of the closing lever 51 forming the completely free tripping state. Thus a tripped state as shown in FIG. 2 is reached.

Under these circumstances, the deenergization of the closing coil 50 permits a reset spring 53 anchored at one end to the pin 32 (see FIG. 1) to further fold the pair of toggle links 31 and 33 so as to decrease the obtuse angle formed therebetween. This results in the rotation in the counterclockwise direction as viewed in FIG. 3 of the closing lever 51. At the same time, a movable iron core 52 is returned to its original or lower position by virtue of its own weight while the reset spring 53 functions to pull the toggle links 31 and 33 upwardly thereby to rotate the guide lever 34 in the counterclockwise direction as viewed in FIG. 3 until the tripping roller 42 engages the trip lever 43. Then a trip spring 54 anchored to a shaft for the tripping roller 45 as shown in FIG. 1 is operated to engage the tripping roller 45 with the tripping latch 46 through the rotation of the trip lever 43 thereby to return the tripping latch 46 to its original position by means of the action of a spring 55 anchored at the end of the one arm of the tripping latch 46 as shown in FIG. 1. Thus the switching mechanism is automatically reset reaching the open state as illustrated in FIG. 3.

With the closing coil 50 energized in the open state as shown in FIG. 3, the movable iron core 52 is attracted by a stationary iron core 56 to cause the closing push rod 57 to push up a closing roller 58 attached to the closing lever 51 thereby to rotate the closing lever 51 in the clockwise direction. This permits the toggle links 31 and 33 folded to form an angle therebetween to become substantially straight to rotate the contactor lever 30 in the counterclockwise direction against the action of the interrupting spring 36 until the contact assembly is brought into its closed position.

In the closing process just described, the closing roller 38 abuts against the lower edge of the arm **39*a* on the closing latch 39 to slide along the closing latch 39 in the counterclockwise direction while pushing it. Eventually, the roller 38 engages the engaging face 39*b* at the extremity of that arm. Immediately before the completion of the closing process, the spring 41 for the closing latch 39 is operated to rapidly put the extremity of the arms of the closing latch 39 in abutting engagement with the closing roller 38 through the closing process as shown in FIG. 4. This results in the closed state as shown in FIG. 1**.

From the foregoing it will be appreciated that the closing latch 39 is operated in response to the movement of the closing roller 38 so that the movement of the closing latch 39 becomes maximum immediately followed by the closing roller 38 losing its pushing pressure thereby to engage the engaging face **39*b*. Thus the closing latch 39** is returned to its position occupied thereby before the closing operation is initiated.

This movement of the closing latch 39 is transferred to the releasing plate 24 through the releasing links 26 and 26′. Therefore if a high current flows through the terminal 8 on the load side in the closing process effected by the switching mechanism then the stationary iron core 9 for instantaneous tripping attracts the mating movable iron core 10. This permits the end 10′ of the movable iron core 10 to strike the tripping levers 14 and 14′ whereupon the extremity of the trip lever 14′ actuates the trip member 20 to trip the current interrupter into its open position.

It is to be noted, however, that, with the circuit interrupter maintained in its closed position as shown in FIG. 1, the movable iron core 10 is prevented from responding to any flow of high current through the circuit interrupter to be attracted by the stationary iron core 9. This is because the locking plate 16 has its upper edge abutting against the lower edge of the releasing plate 24 by means of the action of the locking spring 23 while having its branched end **16*a* maintained in abutting engagement with the pin 15 on the movable iron core 10. Therefore the circuit interrupter can not be opened. In other words, the movable iron core 10** is disabled in the closed position of the circuit interrupter.

Figure 7:
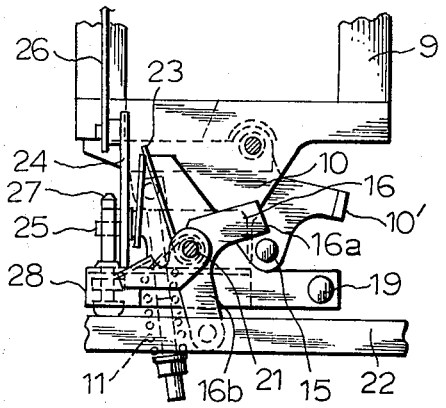
FIG. 7 is a view similar to FIG. 5 but illustrating the instantaneously tripping device shown in FIG. 5 immediately before the switching mechanism completes the closing operation.
Figure 8:
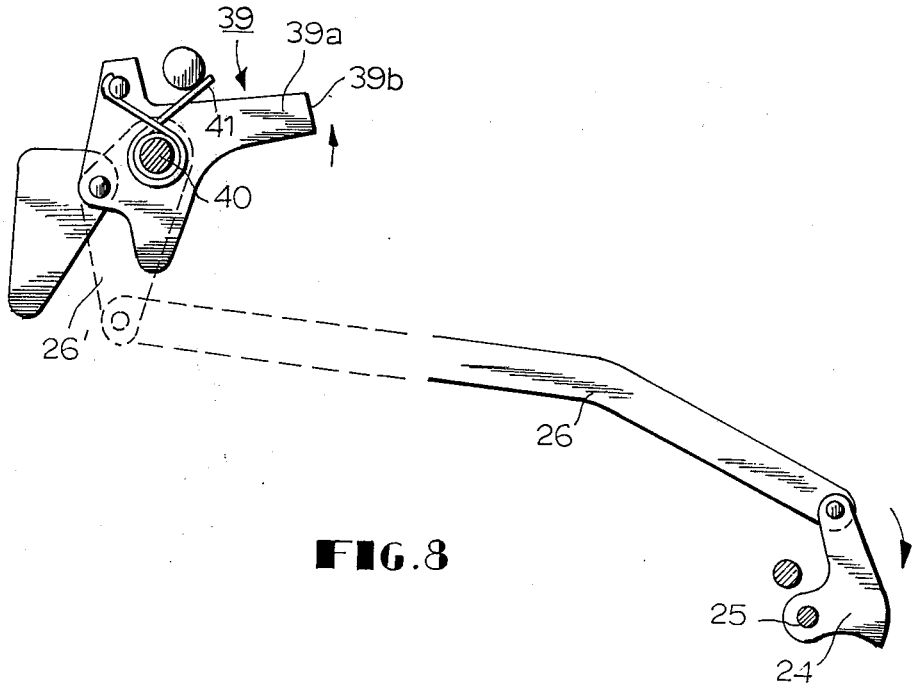
FIG. 8 is a side elevational view of the closing clutch and releasing plate shown in FIG. 1 immediately before the completion of the closing operation.

In the closing process effected by the switching mechanism, the counterclockwise movement of the closing latch 39 as shown in FIG. 8 becomes maximum immediately before the completion of the closing operation. Thus the releasing plate 24 connected to the closing latch 39 through the releasing links 26 and 26′ is rotated in the clockwise direction as viewed in FIG. 8 while the mating locking plate 16 is rotated in the counterclockwise direction as viewed in FIGS. 5 through 7 about the axis of the pin 21 therefor until the branched end **16*a* of the locking plate 16 does not abut against the pin 15 for the movable iron core 10 as shown in FIG. 6**.

Figure 6:
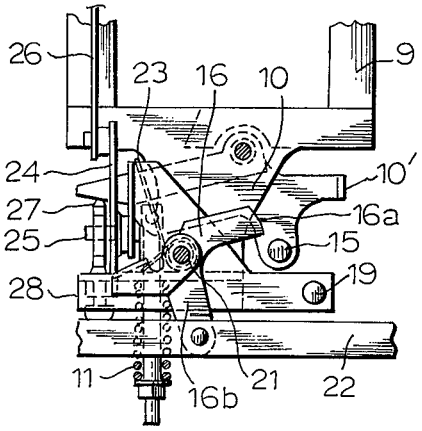
FIG. 6 is a view similar to FIG. 5 but illustrating the instantaneously tripping device shown in FIG. 5 in its operating state.

Even with the movable iron core 10 located in its position as shown in FIG. 6, the same is not attracted by the stationary core 9 in the case a high current such as a shortcircuiting current does not flow through the conductor due to the engagement of the contacts. Therefore the circuit interrupter remains closed. Upon the switching mechanism having completed the closing operation, the closing latch 39 is returned to its closed position as shown in FIG. 1 so that the branched end **16*a* of the locking plate 16 is brought into abutting engagement with the pin 15 for the movable iron core 10. Thus the switching mechanism has completed the closing operation upon reaching the closed position as shown in FIG. 5**.

Assuming that the closing operation has been performed with the associated circuit shortcircuited, the movable iron core 10 in its position as shown in FIG. 6 is attracted by the stationary iron core 9 to cause one end 10′ thereof to strike against the trip levers 14 and 14′. Thus the trip member 20 is upwardly pushed to instantaneously trip the circuit interrupted into its open position.

The present invention has several advantages. For example, the present invention has the short timing trip characteristic while retaining the performance of selective interruption exhibited by conventional trip devices. It eliminates the necessity of performing the operation of completely closing shortcircuiting currents by circuit interrupters required to completely close shortcircuiting current having the duration of several tens of the cycles thereof. Further the closing device providing the closing energy may be relatively small-sized resulting in compact circuit interrupters.

What is claimed is:

1. An instantaneously tripping device operative upon closing a circuit interrupter and comprising instantaneously tripping electromagnet means disposed to encircle a conductor, the electromagnet means including a movable iron core actuatable by a closing latch included in a switching mechanism for a circuit interrupter, through both a locking plate and a releasing plate and a stationary iron core operatively associated with the movable iron core so that, after the completion of the closing operation performed by the switching mechanism, and during the closure of the circuit interrupter, the locking plate locks the movable iron core in its locked position to prevent the movable iron core from being attracted by the stationary iron core, wherein the locking plate is released only in the closing process effected by the switching mechanism to permit the movable iron core to be attracted by the stationary iron core, and wherein, upon a flow of high current through the conductor due to the closure of contacts in the closing process effected by the switching mechanism, the movable iron core is operated to actuate the tripping device to open the contacts.

* * * * *